United States Patent [19]

Reuting

[11] 3,959,759

[45] May 25, 1976

[54] CONTACT DRIVE FOR ELECTRO-MAGNETIC RELAYS

[75] Inventor: Hans-Werner Reuting, Peine, Germany

[73] Assignee: Elmeg Elektro-Mechanik GmbH, Peine, Germany

[22] Filed: Feb. 3, 1975

[21] Appl. No.: 546,800

Related U.S. Application Data

[63] Continuation-in-part of Ser. No. 485,322, July 3, 1974.

[30] Foreign Application Priority Data

Feb. 2, 1974 Germany ..... 2405104

[52] U.S. Cl. ..... 335/203; 335/128; 335/187

[51] Int. Cl.[2] ..... H01H 50/64

[58] Field of Search ..... 335/203, 187, 128, 135, 335/133, 131, 79, 80, 81

[56] References Cited

UNITED STATES PATENTS

| | | | |
|---|---|---|---|
| 2,702,841 | 2/1955 | Bernstein | 335/181 |
| 3,209,095 | 9/1965 | Obszarny | 335/203 |
| 3,211,858 | 10/1965 | Juptner | 335/80 |
| 3,321,722 | 5/1967 | Cohen | 335/133 |

*Primary Examiner*—H. Broome
*Attorney, Agent, or Firm*—Ralf H. Siegemund

[57] ABSTRACT

A relay with two quadrilateral, superimposed yokes, a pivotal armature with stiff contact carriers extending laterally from the ends of the armature and cooperating with contacts mounted on springs. The contact making and braking action takes place between aligned yoke arms.

4 Claims, 1 Drawing Figure

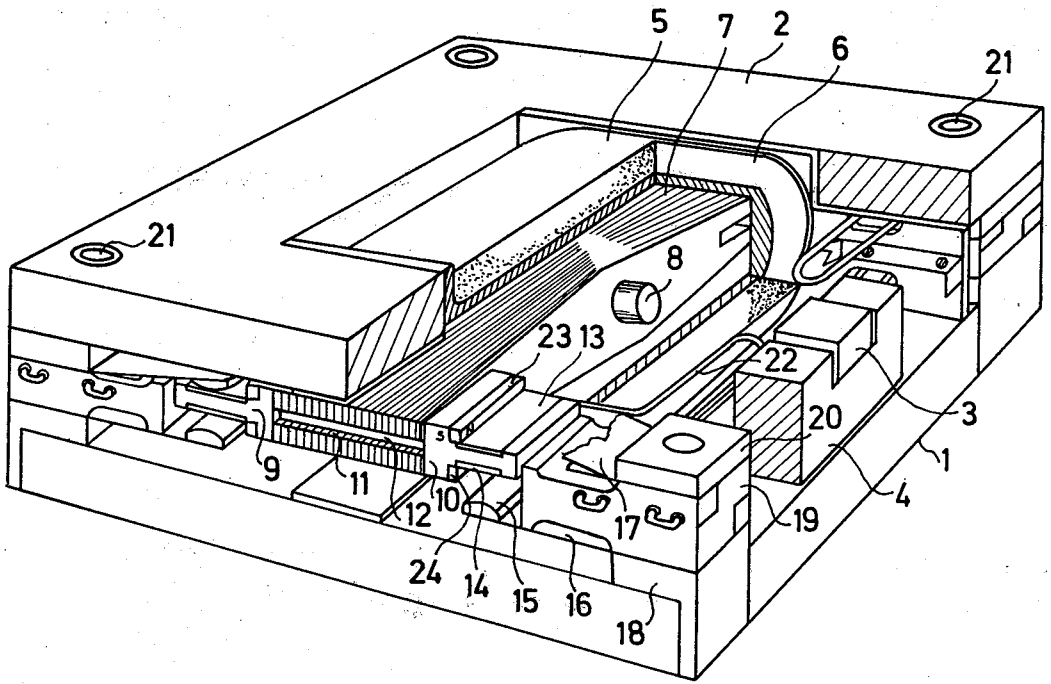
21
6
2
7
5
3
1
4
20
22
19
8
13
23
17
18
16
15
14
10
12
24
11
9
21

CONTACT DRIVE FOR ELECTRO-MAGNETIC RELAYS

The present application is a continuation-in-part application of prior application Ser. No. 485,322, filed July 3, 1974.

BACKGROUND OF THE INVENTION

The invention relates to an electromagnetic relay with mobile and fixed contacts operated by a magnetic armature.

Electromagnetic relays of this kind possess an electro-magnet which when excited causes displacement of a magnetic armature thus operating contacts. Conventionally such contacts are mounted on contact springs pertaining to groups of springs, such group being composed of springs for mobile or displaceable contacts and fixedly mounted springs holding counter contacts. The movement of the armature is transmitted through operating rods to the mobile contact springs so that they move over to the fixed contacts and the electric contacts and the electric circuit is thereby opened or closed.

Operating rods or similar elements must be provided for obtaining a relative movement between the mobile contacts and the fixed contacts. These actuating elements must be connected to the magnetic armature and exactly adjusted, so that they grip the mobile contact springs at the right point in time in relation to the movement of the magnetic armature, thereby effecting a switching of the mobile contact. Apart from the exact adjustment of such operating rods, the mobile contact springs and also the fixed contact springs themselves must still be exactly adjusted, for example, by bending for determining therewith the exact point in time of opening and closing of the contacts. Altogether therefore, several parts are required, which must be exactly prepared and adjusted to enable the relay to perform the switching operation reliably. All this has an adverse effect on the total cost of the relay, on account of the expenditure on material and time required for mounting and adjustment.

DESCRIPTION OF THE INVENTION

It is an object of the present invention to eliminate the above disadvantages and to produce a relay wherein the displacement of the mobile contacts is performed by the magnetic armature in an advantageous manner.

According to the preferred embodiment of the invention, this object is achieved by arranging a displaceable or mobile contact of a relay in rigid connection with the magnetic displaceable armature of the relay, to be driven by the armature without resilient, stroke modifying displacement relative thereto. By the rigid connection of the mobile contacts with the magnetic armature, the need for mobile contact springs and operating rods is obviated. Consequently, the need for adjustment of these elements is also removed. For reliable functioning of the arrangement according to the invention, it is only necessary to adjust the position of the fixed counter contacts, which can, for example, be mounted on fixed contact springs. Thus, by this single adjustment process, it is achieved that the mobile contacts come into or out of contact with the fixed contacts in an exactly predetermined armature stroke position as far as its pivot motion is concerned. Furthermore, space can be saved by such a construction, as any space does not have to be provided for any springs for the displaceable contact. Furthermore, switching action of the contacts is more reliable, since the armature movement effects switching of the contacts directly, without interpositioning of transmission members cooperating with each other.

The construction in accordance with the invention also enables maximum speed of separation of the contacts from each other, because the mobile contacts move with the same speed as the magnetic armature and are not merely displaced by the spring action of the contact springs. This is advantageous in the case of a contact burnout, as because of the high speed of the mobile contact a powerful and long-lasting discharge spark cannot build up so easily.

Also by this arrangement of the mobile contacts the tendency of the relay to bounce is substantially reduced, as the mobile contacts are rigidly united with the body of the armature without interpositioning intermediate elastic elements. Absence of such elements presents the advantage that there is no structure which is liable to vibrate in cooperation with the magnetic forces.

Although according to the invention the mobile elements can be mounted directly on the magnetic armature with only the necessary insulation, according to an advantageous embodiment of the invention, it is proposed that at the free end or free ends of the magnetic armature one or several insulating bodies may be mounted, which carry the displaceable contacts. These insulating carriers are mounted preferably to extend laterally from the ends of the magnetic armature, parallel to its displacement axis. Such insulating bodies are advantageous insofar as they allow the pole piece(s) of the relay to lie directly opposite the end(s) of the magnetic armature while the mobile contacts have disposition with the greates possible separation from the axis of displacement, pivoting or rotation of the magnetic armature, and adequate space is provided for the stationary counter contacts. Due to the thus achieved maximum separation of the mobile contacts with respect to the axis of rotation of the magnetic armature, their speed is equal to the maximum speed of the magnetic armature, which fact is of assistance in facilitating rapid opening and closing of the contacts.

In a further development of the invention, the mounting of the mobile contacts on the insulating bodies also permits that hard or soft magnetic fixing elements should be provided for fixing the insulating bodies to the magnetic armature, thus producing a magnetic flux component parallel to the contact surfaces. Alternatively, permanent magnets may be provided on the insulating bodies, which also create a magnetic flux component parallel to the contact surfaces. In either case a force is exerted on any spark, should it appear between the contact surface of an insulating body and the counter contact running parallelly to the mobile contact surface and perpendicular to the direction of contact movement and of the flux. Therefore, such a spark wanders over the contact surfaces and dose not dwell at a specific point. This action reduces substantially the spark erosion of the contact surfaces and thereby prolongs the life of the relay.

Although in general the fixed contacts may be mounted on any parts, which may, for example, be elastic, it is preferable for the fixed contacts opposite the mobile contacts to be formed as contact springs.

Such arrangement facilitates adjusting the point in time at which the contacts are opened or closed. Trimming and fine adjustment can be achieved by corresponding bending of the contact springs.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is a perspective view of a bistable, polarized holding relay, some parts being removed or cut open to give a better view.

The relay is constructed to have two quadrilateral yokes 1 and 2 each, having rectangular contour with an aperture that is a smaller rectangle. The two yokes are superimposed, rectangle on rectangle, but with a spacer construction in between, established by spacer elements 18, 19, 20, in each of the four corners. Between respective two of the yoke sides as aligned there are arranged permanent magnets 3 and magnetically conductive intermediate pieces 4. Just one such combination ¾ is seen in the view, the other one is interposed between diagonally opposed legs of the yokes 1 and 2.

A coil body 6 carrying an exciter coil 5 is arranged in the region between the openings of the yoke 1 and 2. A magnetic armature 7 is positioned in that coil body. The armature is rotably mounted in the coil body for pivoting about an axis of rotation 8, so that its ends can come into contact with diagonally opposite yoke parts, pertaining to the sides not interconnected by magnets 3 and conductors 4.

Two predominantly flat, insulating elements 9 and 10 are mounted on each end of the magnetic armature 7. These bodies may, for example, consist of plastics material and are fixed to the armature by means of a fastening element 12, such as a magnetizable bar set into a slit 11 provided at the end of the armature. One armature end can be seen in the drawing; the arrangement at the other end is an analogous one. Each of these insulating elements 9 and 10 serve as contact carriers for the displaceable and mobile contacts 13 and 14, respectively on the upper and lower side of the carriers. These contacts are, therefore, moved and displaced up or down as the armature turns on its axis. The contacts follows the displacement of the armature tip without relative, resilient, stroke-modifying movement between them.

Each of the mobile contacts 13 and 14 lies opposite a contact surface of a fixed or stationary counter contact 15. These contacts are respectively fixed to lower contact springs 16 and upper springs 17. It should be mentioned that reference to fixed or stationary contacts does not preclude resilient reaction displacement. Rather it means that such a contact is not actuated by physical connection to a displaceable actuation e.g. an armature.

The contact springs 16 and 17 are each positioned between spacing bodies 18, 19 and 20 mounted at the corners of the relay. The yokes 1 and 2 and the spacing bodies 18, 19 and 20 with their contact springs 16 and 17 which are to be found at each corner are pressed together and held by a nut 21 provided at each corner of the relay.

For supply of current to the mobile contacts, each of the mobile contacts 13 and 14 is connected to a long and rather weak spring 22 which lies in the direction of the length of the armature and extends outwardly to the edge of the relay. Little, if any restoration force is exerted by the spring 22 upon the armature in either of its positions. Contrary thereto the springs 16 and 17 are rather stiff and provide considerable resiliency. Nevertheless, springs 16, 17 in turn are much more elastic than contact carriers 9 and 10.

Next to the mobile contact 13 and 14 there are mounted two permanent magnets 23 and 24 on each of the insulated contact carrier 9 or 10. Each of the magnets produces a flux component in the direction of the contact surfaces of the mobile contacts 13 and 14. These flux components have the effect that, for example, a force is exerted on a spark arising between the mobile contact 14 and the respective cylindrical fixed counter contact 15. This force acts in the direction of the extension of the cylindrical fixed contact 15, so that the spark is driven in the direction of the length of the cylindrical contact.

It is thereby achieved that a spark cannot dwell for a long time at the same place on the contact surfaces but wanders over the contact surfaces, which are therefore less heated and correspondingly less damaged. Instead of the two permanent magnets 23 and 24, the bar shaped holding element 12 can be constructed as a permanent magnet, or if constructed from soft iron, it can produce a corresponding flux dispersion.

It will be understood that the invention is not limited to the disclosed embodiment. All other kinds of electromagnetic relays can be constructed according to the invention.

It is important merely that the mobile contacts should be rigidly connected with the magnetic armature which may, for example, be constructed as a hinged armature, in the described or in another way.

I claim:

1. In an electromagnetic relay having a displaceable armature to be displaced upon energization of a coil means, whereby the armature pivots on an axis, the relay having a contact and at least one stationary counter contact, the improvement comprising, a rigid contact carrier on which said contact is mounted to an extreme end on the armature, remotely from the axis but extending parallel to the axis and not beyond said armature end so that the stroke of the armature end has the same length as the stroke of the contact moving with the said end of the armature and in a direction transverse to said axis, the carrier being made of insulating material there being at least one contact on the carrier, being driven by the armature and following its movement without resilient, stroke-modifying displacement relative thereto, said stationary counter contact being laterally displaced from the armature for selective engagement with and disengagement from the contact on the contact carrier upon displacement respectively of the armature in the one or the respective opposite direction; and a carrier for said stationary counter contact and having greater resiliency than said carrier on said armature.

2. In a relay as in claim 1, wherein said carrier for said counter contact is a spring.

3. In a relay as in claim 1, including a spring of a low spring constant for running current to the contact of the carrier and imparting only negligible resilient reaction upon the armature.

4. In a relay as in claim 1 and including a yoke structure having at least one leg, disposed adjacent to said armature end, the leg extending parallelly to said contact carrier, the armature end abutting against the leg following a pivot motion about said axis.

* * * * *